United States Patent [19]

Wells

[11] Patent Number: 4,967,474

[45] Date of Patent: Nov. 6, 1990

[54] HAND-HELD POWER-OPERATED SHEARS

[76] Inventor: Andrew J. Wells, 6257 Star Ln. N.W., Bemidji, Minn. 56601

[21] Appl. No.: 498,821

[22] Filed: Mar. 26, 1990

[51] Int. Cl.[5] ..... B26B 15/00; B26B 13/00; B26B 13/04; B26B 17/00

[52] U.S. Cl. ..... 30/228; 30/180; 30/241; 30/249

[58] Field of Search ..... 30/175, 178, 180, 186, 30/188, 227, 228, 236, 238, 239, 241, 245, 249, 272 R; 72/409, 412; 269/32

[56] References Cited

U.S. PATENT DOCUMENTS

| | | | |
|---|---|---|---|
| 3,710,445 | 1/1973 | Roth | 30/228 |
| 4,359,821 | 11/1982 | Pellenc | 30/249 |
| 4,382,331 | 5/1983 | Kimura | 30/180 |
| 4,558,418 | 7/1984 | McSmith et al. | 30/272 R |
| 4,791,726 | 12/1988 | Alley, Jr. | 30/180 |

*Primary Examiner*—Douglas D. Watts
*Assistant Examiner*—Paul M. Heyrana, Sr.
*Attorney, Agent, or Firm*—Burd, Bartz & Gutenkauf

[57] ABSTRACT

A hand-held fluid power-operated shears characterized by a body including a pistol grip handle portion, a blade-receiving recess and a cylindrical cavity with a removable cover over the blade-receiving recess. One of a variety of different size and design pairs of interchangeable shear blades may be installed in the blade-receiving recess. The blades are pivotally connected and each has a forward cutting section projecting forwardly of the housing and a rearward extension, the extensions being removably received in the blade-receiving recess to hold one blade fixed while permitting relative movement of the other. One end of a piston rod is fixed to a piston provided in the cylindrical cavity for reciprocal movement therein. The other end of the piston rod is in direct detachable engagement with the rearward end of the extension of the relatively movable shear blade. Fluid flow passages are provided within the body, being adapted for connection to a source of fluid under pressure and in communication with the cylindrical cavity on opposite sides of the piston for introduction of fluid thereto and exhaust fluid therefrom. Valve mechanisms are provided for controlling flow of fluid through the shears. Power trigger mechanisms which are operable from the pistol grip handle are provided to actuate the control valve mechanisms and safety trigger mechanisms are provided operable from the pistol grip handle to prevent accidental operation of the power trigger.

20 Claims, 4 Drawing Sheets

HAND-HELD POWER-OPERATED SHEARS

BACKGROUND OF THE INVENTION

1. Field of the Invention

This invention is directed to a hand-held power-operated shears. Although designed for and intended primarily for dismemberment of poultry into parts for processing, the shears may obviously be used for other cutting operations requiring repeated and fatiguing operation of a shears.

2. The Prior Art

The following U. S. patents are exemplary of the prior art:

Wild; 2,733,506; Feb. 7, 1956
Bidin; 2,791,028; May 7, 1957
Dawson; 2,818,643; Jan. 7, 1958
Kellersman et al; 3,165,780; Jan. 19, 1965
Fischer et al; 3,177,583; Apr. 13, 1965
Frenzel; 3,255,525; June 14, 1966
Jahnke; 3,893,237; July 8, 1975
Pellenc; 4,109,381; Aug. 29, 1978
Ailey; 4,791,726; Dec. 20, 1988

Essentially the cutters of these patents each has a pair of blades, at least one of which is connected to a piston and piston rod in a fluid operated cylinder, which is actuated by a trigger. In most instances the return stroke is the result of spring action, but the Wild, Ailey and Pellenc patents show a positive fluid-powered return. Both blades are movable in the cutters of the Jahnke and Bidin patents. In several of the patents, as exemplified by Frenzel, Bidin, Jahnke and Pellenc, there is an extra link between the movable blade and the piston rod. Others have a direct linkage. The Kellersman et al, Jahnke and Ailey patents refer to the use of power shears specifically for cutting poultry.

SUMMARY OF THE INVENTION

Broadly stated, the hand-held power-operated shears according to the present invention comprises a body including a pistol grip handle portion, a blade-receiving recess and a cylindrical cavity. The blade-receiving recess has a removable cover. A pair of pivotally connected interchangeable blades each have a forward cutting section and a rearward extension. When the blades are in place, the cutting sections project forwardly of the housing and the rearward extensions are removably received in the blade-receiving recess so as to hold one blade fixed while permitting relative movement of the other. A piston is positioned in the cylindrical cavity for fluid-tight sliding reciprocal movement therein. One end of a piston rod is fixed to the piston and the other end is in direct detachable engagement with the rearward end of the extension of the relatively movable blade. There are fluid flow passages within the body which are adapted for connection to a source of fluid under pressure and are in communication through a flow control valve with the cavity on opposite sides of the piston for introduction of fluid to the cavity and exhaust of fluid therefrom. The control valve means is operated by a power trigger from the pistol grip handle. Safety features are provided in the form of a safety trigger which prevents accidental operation of the power trigger and in the form of a guard and safety knob to prevent the fingers of the operator from being accidentally engaged with the shears blades.

BRIEF DESCRIPTION OF THE DRAWINGS

The invention is illustrated in the accompanying drawings in which corresponding parts are identified by the same numerals and in which.

DETAILED DESCRIPTION OF THE PREFERRED EMBODIMENT

Figure 1:
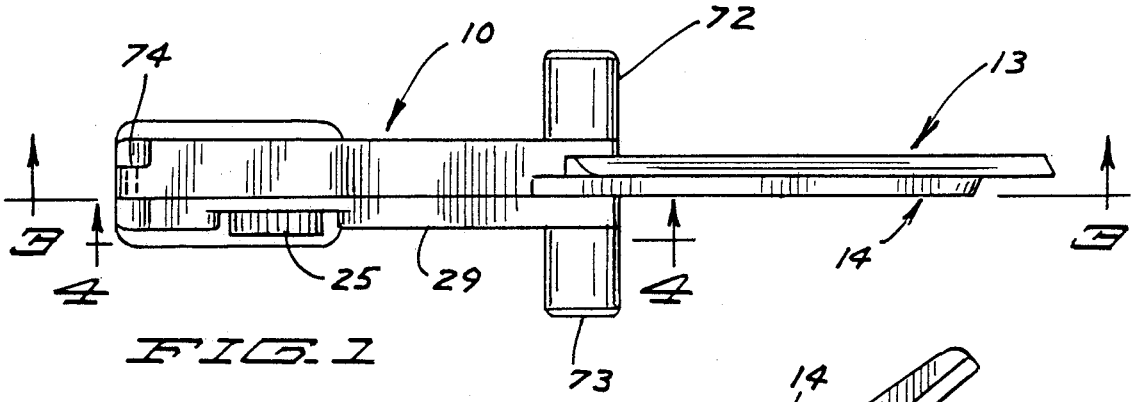
FIG. 1 is a top view of the shears according to the present invention.
Figure 2:
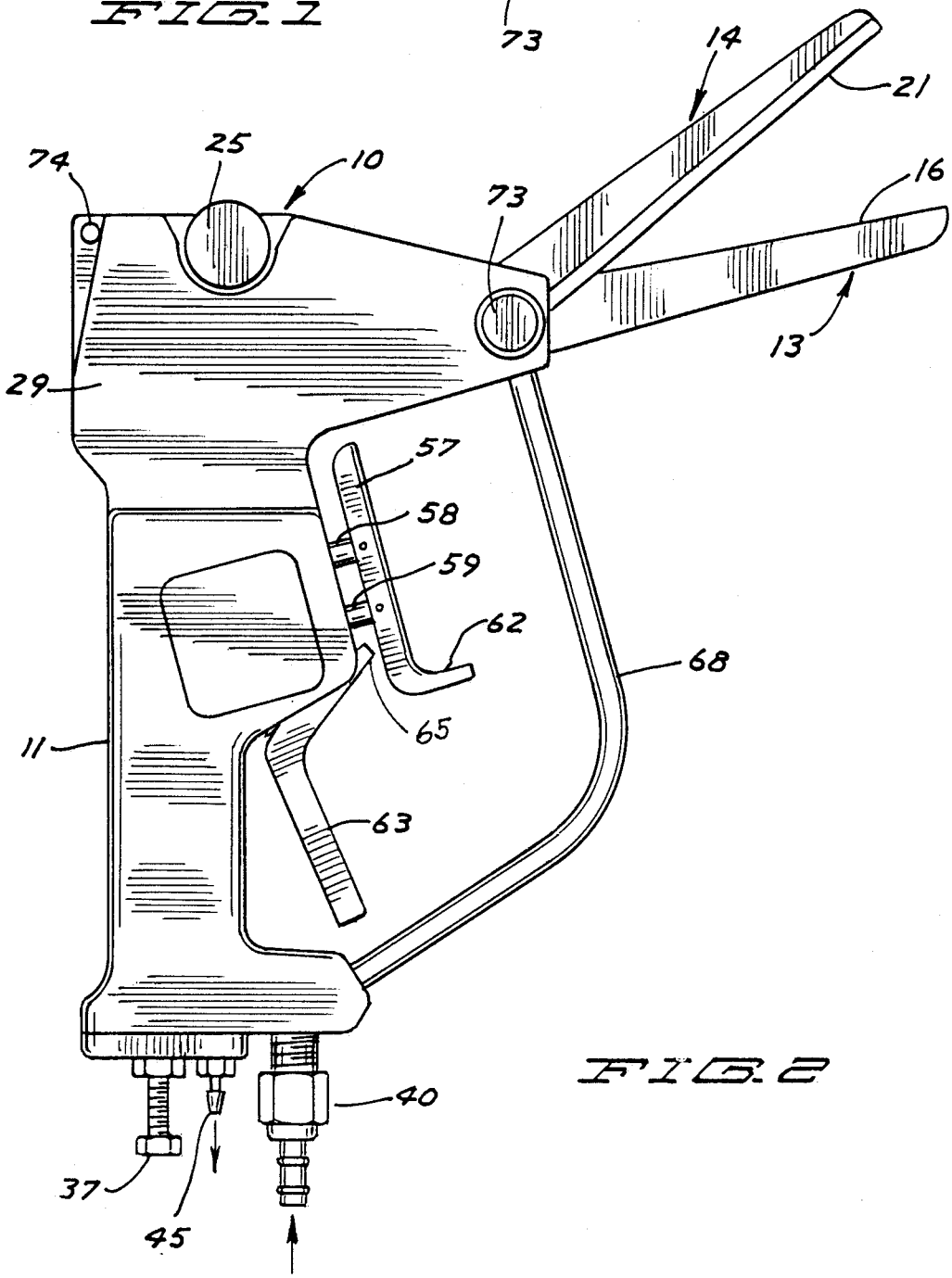
FIG. 2 is a right hand side elevation thereof.

Referring now to the drawings, the hand-held power-operated shears according to the present invention comprises a body, indicated generally at 10, having a pistol grip handle 11 and a blade-receiving recess 12 in the body above the handle. The shears includes a pair of blades, a fixed blade indicated generally at 13 and a movable blade 14 pivotally attached thereto at 15. Fixed blade 13 includes a forward cutting section 16 projecting forwardly of the housing 10 and a rearward extension 17 received in a channel 18 in the recess 12 of equal dimension to fix blade 13 against transverse movement. The pivotal connection 15 between blades 13 and 14 includes a projecting screw head which fits into a depression in the blade-receiving recess 12 to prevent longitudinal movement of blade 13.

Movable blade 14 includes a forward cutting section 21 and a rearward extension 22. The rearwardmost end of extension 22 includes a longitudinal open-ended slot 23 for engagement with a piston rod, as explained hereinafter. The top edge of extension 22 includes a notch 24 to provide clearance for a thumb screw 25, as explained hereinafter. Movement of blade 14 is limited by virtue of the bottom edge 26 of extension 22 engaging a screw head 27 projecting from the extension 17 of fixed blade 13. To provide adjustability of the relative movement between the blades, a plurality of closely spaced threaded holes 28 are preferably provided extending across the width of the extension, each adapted to receive screw 27. Blades 13 and 14 are preferably formed from extremely hard heat-treated stainless steel.

In order to provide easy access to the blade receiving recess 12 for removal of blades 13 and 14, a removable cover plate 29 is provided. Cover 29 preferably nestingly engages the body in order to permit it to be held firmly in place by means of a single thumb screw 25, preferably provided with an oversize knurled head to permit easy attachment to and disengagement from the body 10. Body 10 and cover plate 29 are preferably formed from aircraft aluminum for strength and light weight.

The body 10 includes a cylindrical cavity 30 in which a piston 31 is disposed for fluid-tight sliding reciprocal movement therein. Cylinder cavity 30 may be disposed in the pistol grip handle 11, or, for heavy duty shears requiring greater power, a larger cylindrical cavity may be incorporated into a body extension below the pistol grip. A piston rod 32 is fixed to piston 31, as by screw 33, and extends for fluid-tight sliding reciprocal movement through a bushing 34 into the blade-receiving recess 12. The outermost free end of piston rod 32 includes an open ended longitudinal slot 35. Slot 35 is spanned by a transverse pin 36 adjacent the open end of the slot. The rearward end of extension 22 of movable blade 14 extends through slot 35 and slot 23 in the extension engages pin 36.

Figure 3:
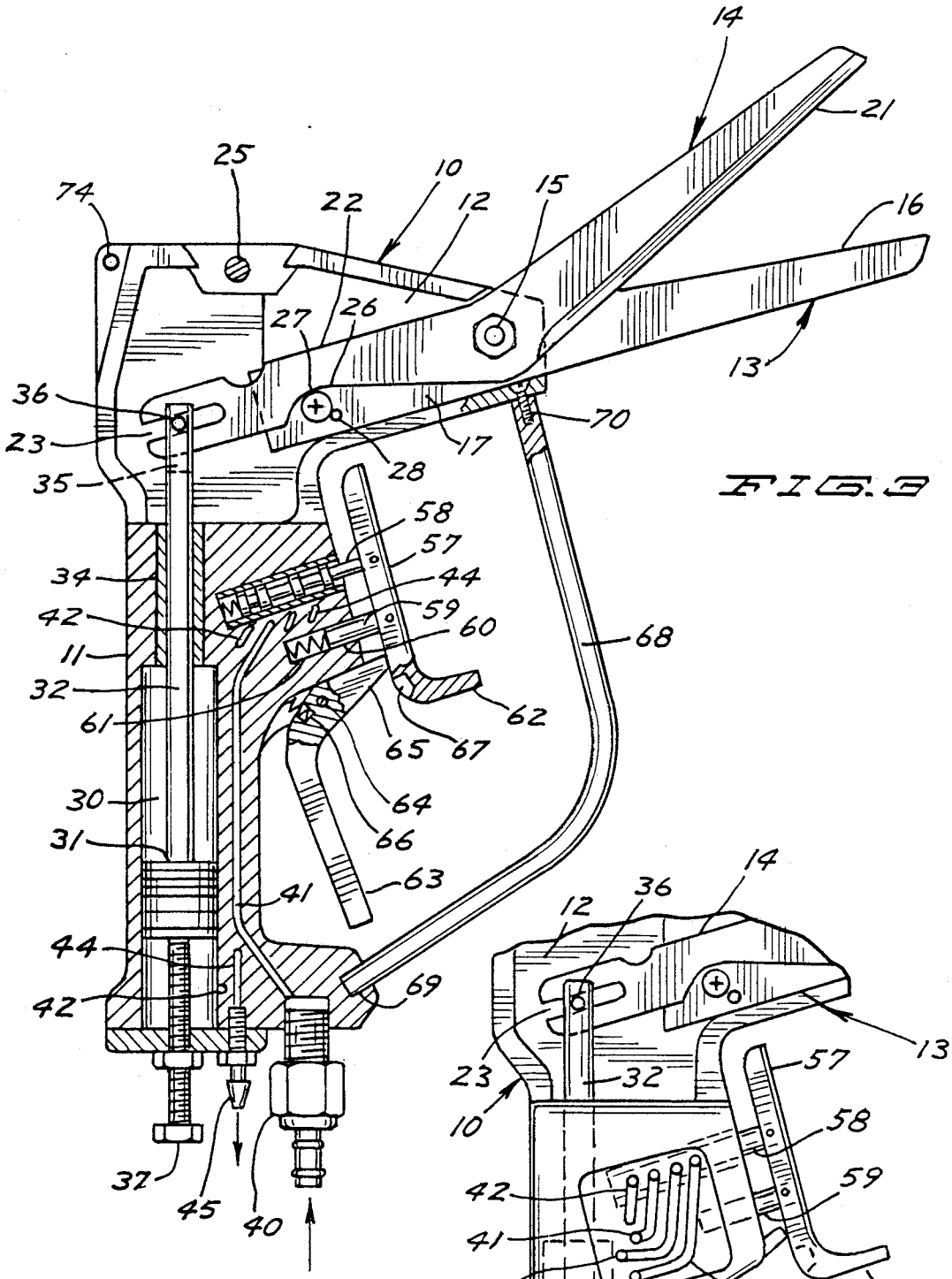
FIG. 3 is a section on the line 3—3 of FIG. 1 and in the direction of the arrows showing the blades in their normal at-rest open position.
Figure 4:
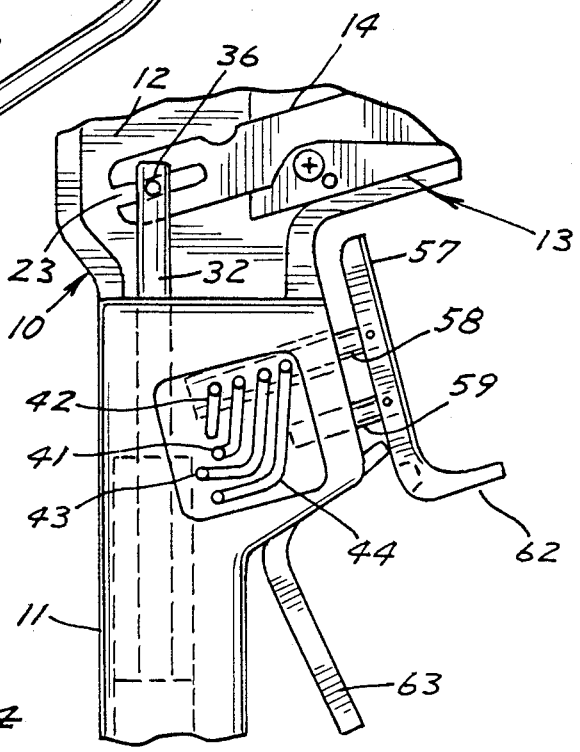
FIG. 4 is a fragmentary section similar to FIG. 3 but generally on the line 4—4 of FIG. 1 and in the direction of the arrows showing hidden fluid flow lines in the handle.
Figure 5:
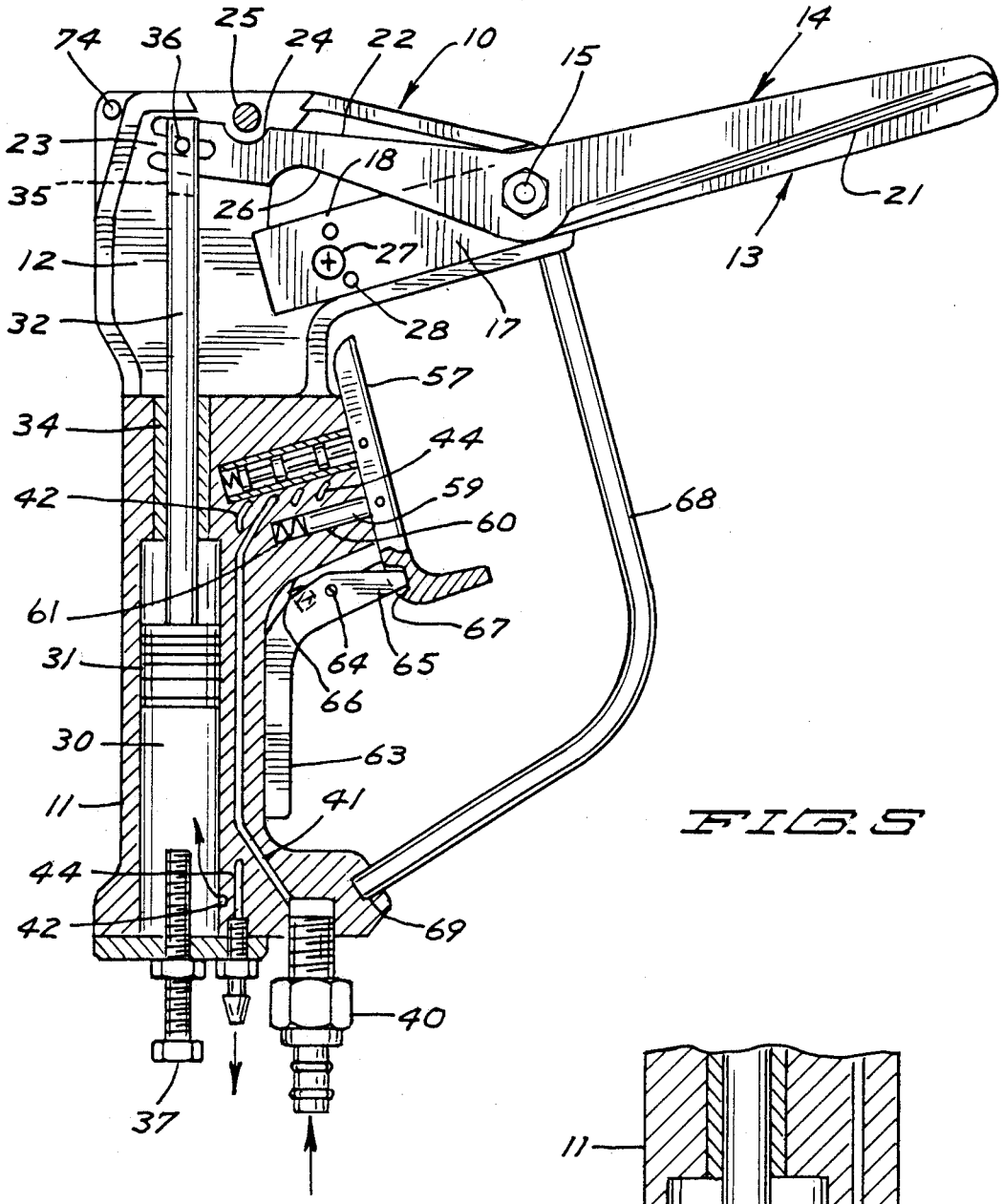
FIG. 5 is a section similar to FIG. 3 but showing the blades in closed position.
Figure 6:
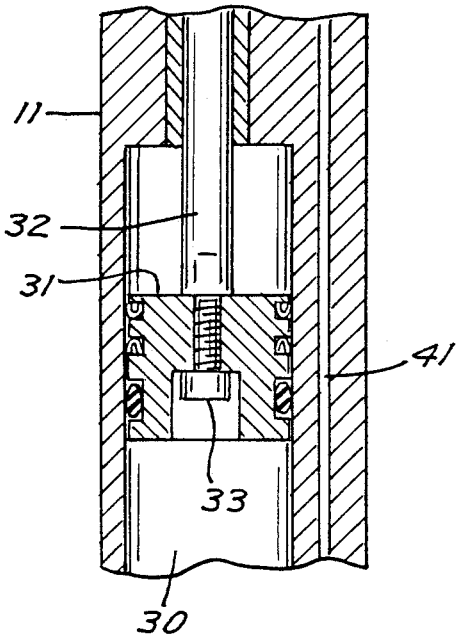
FIG. 6 is a fragmentary section on an enlarged scale showing details of piston and piston rod.

As seen by comparison of FIGS. 3 and 5, upon extension of piston rod 35 by introduction of fluid to cylinder 30 below the piston, blade 14 is moved from its normal at-rest open position relative to blade 13, through a cutting operation, to a closed position. There is a direct operating connection between the piston rod and movable blade. Yet, the blades are readily disengaged from the piston rod upon removal of cover 29 to remove the blades for cleaning, for replacement with blades of a different size, or resharpened blades of the same size, or the like. An alternative means for adjustment of the degree of movement between the blades may be provided by screw 37 in fluid-tight engagement with the bottom of cavity 30, by which the length of the stroke of piston 31 may be adjusted.

The power shears of the present invention are operated by fluid pressure. Preferably the fluid is a gas under pressure and preferably the gas is air. However, liquids as are commonly used in hydraulically operated equipment may optionally be used. Especially for food processing operations, pneumatic power is preferred to minimize the possibility of contamination of the food products.

Body 10 is provided with a fitting 40 adapted for connection to a source of fluid under pressure. Fitting 40 communicates with a first fluid flow line 41 connected to a control valve, as described hereinafter. Depending upon the position of the valve, the fluid is directed either to flow line 42 to the bottom end of cylinder cavity 30 or through flow line 43 to the top end of the cylinder cavity on the opposite side of piston 31. Depending upon the direction of movement of piston 31, flow lines 42 and 43 function alternately to introduce fluid to the cylinder cavity or to exhaust fluid therefrom through the control valve to an exhaust flow line 44 which terminates in an exhaust fitting 45. As shown schematically in FIGS. 7 and 8, fittings 40 and 45 each include a one-way check valve 46 and 47, respectively, to prevent entry of water into the fluid flow lines and cylinder cavity during washing of the shears.

Figure 7:
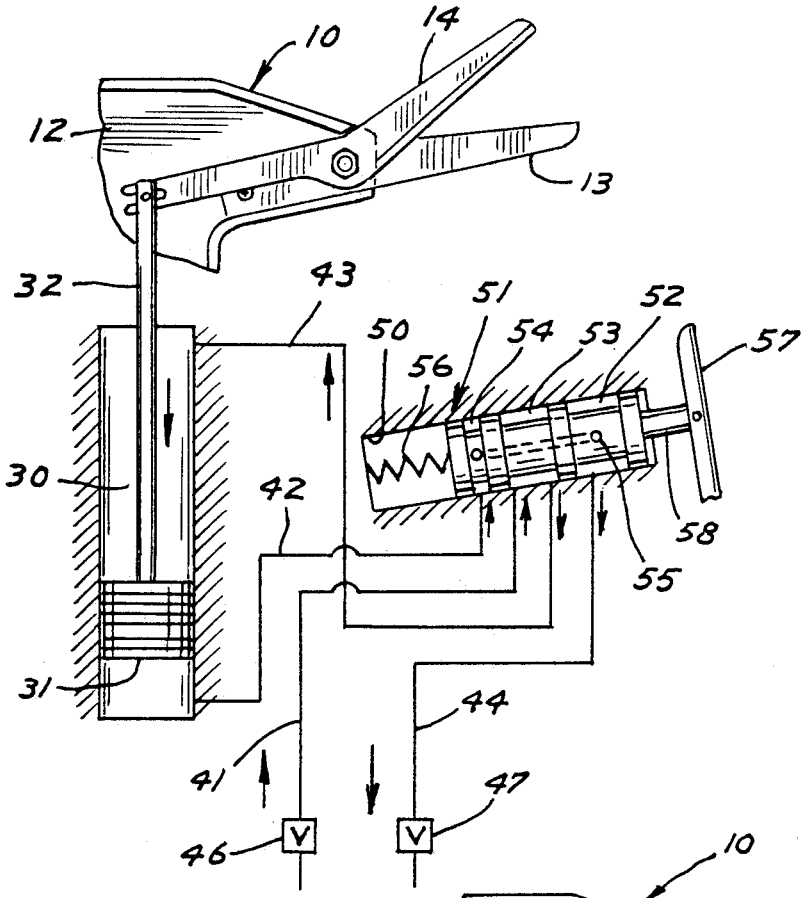
FIG. 7 is a schematic diagram showing the fluid flow lines and relative positions of the parts when the shears is in its normal at-rest position with blades open.
Figure 8:
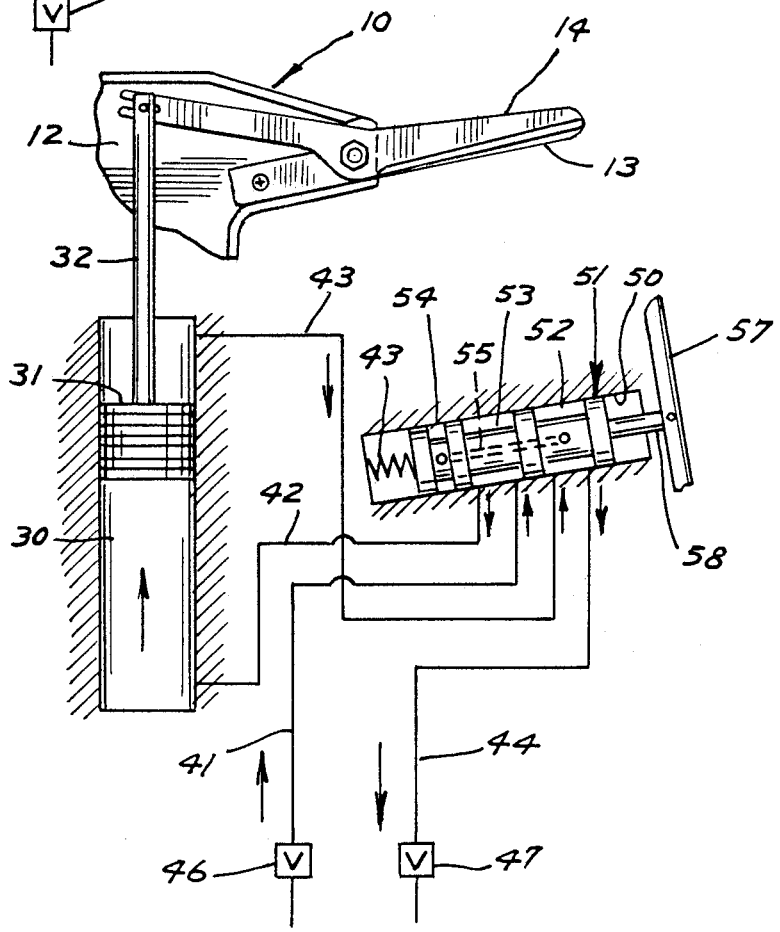
FIG. 8 is a similar schematic diagram showing the position of parts after operation of the shears to its closed blade position.

The manner in which fluid flow is controlled to operate the shears is best shown in FIGS. 7 and 8. The control valve means includes a cylindrical passage 50 in body 10. Fluid flow passages 41–44 intersect the wall of passage 50 in a row of uniformly spaced apart aligned ports. A cylindrical valve element, indicated generally at 51, is fitted for fluid-tight slidable reciprocal movement in passage 50. Valve element 51, shown as a spool valve, has first and second annular peripheral passages 52 and 53, respectively, each of a width capable of communicating with two ports in the wall of cylindrical passage 50. A third annular passage 54 is of a width to engage only a single port. An internal passage 55 connects the first and third annular passages 52 and 54, respectively. Valve element 51 is biased by coil spring 56 to extend outwardly toward the operating trigger to maintain the shears in their normal at-rest position with blades open, as seen in FIG. 7.

Power trigger 57 is operable by engagement of one or more fingers of a hand engaging the pistol grip handle 11 and includes a pin 58 which fixedly engages valve element 51. Upon application of finger pressure against spring 56, the valve element is moved from the position of FIG. 7 to that of FIG. 8. Annular passage 53 then is in communication with fluid flow passages 41 and 42 which permits fluid to flow to the lower end of cylinder cavity 30 to force piston 31 and piston rod 32 upwardly to close the blades. At the same time, the fluid expelled from the upper end of the cylinder cavity passes through fluid flow passage 43 to annular valve passage 52 and thence through flow passage 44 to exhaust fitting 45. Upon release of finger pressure from the trigger 57, spring 56 forces the valve element back to its normal at-rest position shown in FIG. 7. Then fluid from the inlet flow passage 41 flows to peripheral valve passage 53 from whence it passes through flow passage 43 to the upper end of the cylinder cavity where it forces the piston 31 downwardly to reopen the shears blades. The fluid expelled from the lower end of cylinder cavity 30 then passes through flow passage 42 to valve peripheral passage 54 and through internal passage 55 to annular valve passage 52 and thence through flow passage 44 to exhaust fitting 45. Thus, each operation of trigger 57 causes one cutting function to be performed and release of the trigger positively reopens the blades for the next cutting operation.

Although valve element 51 is shown as a spool valve, it may alternatively have aligned longitudinal peripheral slots in lieu of annular passages 52 and 53 and a simple recess communicating with internal passage 55 in lieu of annular passage 54. Proper alignment is insured by a second pin 59 forming part of trigger 57 and reciprocable in a passage 60 in the handle 11. Passage 60 is spaced from and parallel to valve passage 50. Pin 59 is biased in its outwardmost position by spring 61. Trigger 57 preferably has a forwardly projecting portion 62 which serves as a finger rest and reduces fatigue.

In order to prevent premature or accidental operation of power trigger 57, a safety trigger 63 is provided. Safety trigger 63 is pivotally secured at 64 set in a channel in body 10 adjacent the bottom end of power trigger 57. The safety trigger has a forwardly projecting nose 65 normally maintained spring biased in engagement with the bottom rear surface of power trigger 57 by means of a coil spring 66 seated in a recess in the top of the safety trigger (FIG. 3). The power trigger 57 is rendered inoperative until the safety trigger 63 is first grasped by one or more fingers of the operator's hand engaging the pistol grip handle. When trigger 63 is depressed against its spring biasing means 66, the nose 65 enters a notch 67 at the bottom rear surface of the power trigger, thus permitting the power trigger to be depressed to operate the shears to close the blades as heretofore described in connection with FIGS. 7 and 8. When finger pressure on both triggers is released, both triggers resume their normal at-rest positions by virtue of their spring biasing and further operation of the power trigger is prevented until the safety trigger is once again depressed.

An arcuate safety guard 68 is provided spaced forwardly of the power trigger and safety trigger to prevent the operator's fingers from engagement with the cutting blades. One end of guard 68 is set into a recess 69 in the forward edge of the bottom end of the pistol grip handle. An axially extending threaded hole is provided in the opposite end of guard 68 permitting the guard to be held firmly in place by means of a single screw 70 extending from the forward edge of the blade receiving recess 12 (FIG. 3).

For additional safety to prevent accidental engagement of the operator's fingers by the cutting blades, as best seen in FIG. 1, safety knobs 72 and 73 are provided projecting laterally outwardly, respectively, from body 10 and cover 29 at the forwardmost edges thereof adjacent the forward cutting sections of the blades. A tool balancer lift point in the form of a counter-balance eyelet 74 is provided at the top rearward end of body 10.

The power operated shears according to the present invention are safe, easy to use, and simple to clean. They may be fitted with blades of different sizes and design. They may be operated to produce from about four to eight cuts per second As compared to use of hand shears and knives, Carpel Tunnel Syndrome can be greatly reduced and productivity increased.

It is apparent that many modifications and variations of this invention as hereinbefore set forth may be made without departing from the spirit and scope thereof. The specific embodiments described are given by way of example only and the invention is limited only by the terms of the appended claims.

I claim:

1. A hand-held power-operated shears comprising:

(A) a body including a pistol grip handle portion, a blade-receiving recess and a cylindrical cavity, (B) a removable cover over said blade receiving recess, (C) a pair of pivotally connected interchangeable blades, each having a forward cutting section projecting forwardly of the housing and a rearward extension, said extensions being removably received in said recess to hold one blade fixed while permitting relative movement of the other, (D) a piston in said cylindrical cavity for fluid-tight sliding reciprocal movement therein, (E) a piston rod having one end fixed to said piston and the other end in direct detachable engagement with the rearward end of the extension of the relatively movable blade, (F) fluid flow passages within said body adapted for connection to a source of fluid under pressure and in communication with said cavity on opposite sides of said piston for introduction of fluid thereto and exhaust of fluid therefrom, (G) valve means controlling flow of fluid through said passages, (H) power trigger means operable from said pistol grip handle to actuate said valve means, and (I) safety trigger means operable from said piston grip handle and engageable with said power trigger means to prevent accidental operation thereof.

2. A hand-held power-operated shears according to claim 1 wherein:

(A) said blade-receiving recess of the body includes a channel of size and shape to receive the rearward extension of the fixed blade therein, and (B) the pivotal connection between said blades includes a projecting screw head and a depression in said channel to receive said screw head and fix the blade against longitudinal movement.

3. A hand-held power-operated shears according to claim 1 wherein:

(A) the rearward end of the extension of the movable blade has an open-ended slot therein, (B) the free end of said piston rod has an open-ended longitudinal slot therein with a transverse pin spanning the slot adjacent the open end thereof, and (C) the slot of the movable blade engages said pin.

4. A hand-held power-operated shears according to claim 1 wherein:

(A) the rearward extension of the fixed blade has a plurality of closely spaced threaded openings extending across the width thereof and adapted to receive a screw therein, and (B) the bottom edge of the rearward extension of the movable blade is engageable with said screw to limit movement of the movable blade.

5. A hand-held power-operated shears according to claim 1 wherein:

(A) said body includes a fluid inlet fitting adapted for connection to a source of fluid under pressure, and a fluid exhaust port, (B) a fluid flow passage extends from said fitting through the control valve to each end of the cylindrical cavity on opposite sides of the piston and a fluid flow passage extends from each end of said cavity through the control valve to said fluid exhaust port.

6. A hand-held power-operated shears according to claim 5 wherein said fluid inlet fitting and exhaust port each includes a one-way check valve to prevent accidental entry of water into the fluid passages during washing of the shears.

7. A hand-held power-operated shears according to claim 6 wherein said valve means includes:

(A) a cylindrical passage having longitudinally aligned spaced apart ports in the wall thereof communicating with the fluid inlet and exhaust and with opposite ends of the cylindrical cavity, (B) a cylindrical valve element reciprocable in said cylindrical passage, and (C) passages in said valve element alternately connecting opposite ends of the cylindrical cavity with the fluid inlet and exhaust.

8. A hand-held power-operated shears according to claim 7 wherein said reciprocable valve element comprises:

(A) a cylindrical body, (B) a first and second passage in the periphery of said body, each positioned to communicate with two of the ports in the valve wall, (C) a third passage in the periphery of said body positioned to communicate with one of said ports, and (D) an internal passage through the cylindrical body connecting said first and third peripheral passages.

9. A hand-held power-operated shears according to claim 7 wherein said power trigger means comprises:

(A) a trigger adapted for engagement by one or more fingers, (B) a first pin projecting from the rear surface of the trigger and engaging said valve element, (C) a second pin parallel to the first and spaced therefrom, said second pin being receivable in a passage in the forward edge of the pistol grip handle to prevent turning of the trigger.

10. A hand-held power-operated shears according to claim 9 wherein said reciprocable cylindrical valve element and second trigger pin are spring biased into their forwardmost positions.

11. A hand-held power-operated shears according to claim 9 wherein said safety trigger comprises:

(A) an angular member pivotally secured in said pistol grip handle and having:

(1) a downwardly projecting finger-engaging portion, and (2) a forwardly extending power trigger engaging portion alternately engaging the rear surface of the trigger and a safety release recess therein, and (B) spring biasing means normally urging said safety trigger into engagement with the rear surface of the power trigger to render it inoperative.

12. A hand-held power-operated shears according to claim 1 wherein:

(A) a safety guard recess is provided in the forward edge of the bottom end of said pistol grip handle, (B) an arcuate safety guard is provided spaced forwardly of said power trigger and safety trigger means, one end of said safety guard being set into and engaging said safety guard recess, (C) an axially extending threaded hole is provided in the opposite end of said guard, and (D) a screw extending from the forward edge of the blade-receiving recess of the body into said threaded hole secures the safety guard in place.

13. A hand-held power-operated shears according to claim 1 wherein transversely extending safety knobs project outwardly from said body and cover at the forwardmost edge thereof adjacent the forward cutting sections of said blades.

14. A hand-held power-operated shears comprising:

(A) a body including a pistol grip handle portion, a blade-receiving recess and a cylindrical cavity, (B) a removable cover over said blade-receiving recess, (C) a pair of pivotally connected interchangeable blades each having a forward cutting section projecting forwardly of the housing and a rearward extension, said extensions being removably received in said recess to hold one blade fixed while permitting relative movement of the other, the rearward end of the extension of the movable blade having an open-ended slot therein, (D) a piston in said cylindrical cavity for fluid-tight sliding reciprocal movement therein, (E) a piston rod having one end fixed to said piston, an open end longitudinal slot at the opposite end and a transverse pin spanning the slot adjacent the open end thereof, said pin engaging the slot of said movable blade, (F) a fluid inlet fitting adapted for connection to a source of fluid under pressure, and a fluid exhaust port, (G) a fluid flow passage extending from said inlet fitting through a control valve to each end of the cylindrical cavity on opposite sides of the piston, and a fluid flow passage extending from each end of said cavity through a control valve to said exhaust port, (H) valve means controlling the flow of fluid through said passages and including:

(1) a cylindrical passage having longitudinally aligned uniformly spaced apart ports in the wall thereof communicating with the fluid inlet and exhaust and opposite ends of the cylindrical cavity, (2) a spring biased cylindrical valve element reciprocable in said cylindrical passage, and (3) passages in said valve element alternately connecting opposite ends of the cylindrical cavity with the fluid inlet and exhaust, (I) power trigger means operable from said pistol grip handle to actuate said valve means and comprising:

(1) a trigger adapted for engagement by one or more fingers, (2) a first pin projecting from the rear surface of the trigger and engaging said valve element, and (3) a spring biased second pin parallel to the first and spaced therefrom, said second pin being receivable in a passage in the forward edge of the pistol grip handle to prevent turning of the trigger, and (J) safety trigger means operable from said pistol grip handle and comprising:

(1) an angular member pivotally secured in said pistol grip handle and having:

(a) a downwardly projecting finger-engaging portion, and (b) a forwardly extending power trigger engaging portion alternately engaging the rear surface of the trigger and a safety release recess therein, and (2) spring biasing means normally urging said safety trigger into engagement with the rear surface of the power trigger to render it inoperative.

15. A hand-held power-operated shears according to claim 14 wherein:

(A) said blade-receiving recess of the body includes a channel of size and shape to receive the rearward extension of the fixed blade therein, and (B) the pivotal connection between said blades includes a projecting screw head and a depression in said channel to receive said screw head and fix the blade against longitudinal movement.

16. A hand-held power-operated shears according to claim 14 wherein:

(A) the rearward extension of the fixed blade has a plurality of closely spaced threaded openings extending across the width thereof and adapted to receive a screw therein, and (B) the bottom edge of the rearward extension of the movable blade is engageable with said screw to limit movement of the movable blade.

17. A hand-held power-operated shears according to claim 14 wherein said fluid inlet fitting and exhaust port each includes a one-way check valve to prevent accidental entry of water into the fluid passages during washing of the shears.

18. A hand-held power-operated shears according to claim-14 wherein said reciprocable valve element comprises:

(A) a cylindrical body, (B) a first and second passage in the periphery of said body, each positioned to communicate with two of the ports in the valve wall, (C) a third passage in the periphery of said body positioned to communicate with one of said ports, (D) an internal passage through the cylindrical body connecting said first and third peripheral passages.

19. A hand-held power-operated shears according to claim 14 wherein;

(A) a safety guard recess is provided in the forward edge of the bottom end of said pistol grip handle;

(B) an arcuate safety guard is provided spaced forwardly of said power trigger and safety trigger means, one end of said safety guard being set into and engaging said safety guard recess, (C) an axially extending threaded hole is provided-in the opposite end of said guard, and (D) a screw extending from the forward edge of the blade-receiving recess of the body into said threaded hole secures the safety guard in place.

20. A hand-held power-operated shears according to claim 14 wherein transversely extending safety knobs project outwardly from said body and cover at the forwardmost edge thereof adjacent the forward cutting sections of said blades.

* * * * *